US005215404A

United States Patent [19]

Raymond

[11] Patent Number: 5,215,404

[45] Date of Patent: Jun. 1, 1993

[54] SCREED UNIT FOR ASPHALT PAVING MACHINE

[75] Inventor: Larry Raymond, Tacoma

[73] Assignee: Carlson Paving Products, Inc., Tacoma, Wash.

[21] Appl. No.: 847,181

[22] Filed: Mar. 6, 1992

[51] Int. Cl.[5] ..... E01C 19/22

[52] U.S. Cl. ..... 404/118

[58] Field of Search ..... 404/118-120, 404/83-86, 96

[56] References Cited

U.S. PATENT DOCUMENTS

| | | | |
|---|---|---|---|
| 1,330,783 | 2/1920 | Chase et al. | 404/118 X |
| 2,481,679 | 6/1945 | Miller et al. | 404/118 X |
| 2,662,313 | 12/1953 | Mowe et al. | 404/118 X |
| 3,396,642 | 8/1968 | Martinson | 404/118 X |
| 3,398,663 | 8/1968 | Matich | 404/118 X |
| 4,364,690 | 12/1982 | Bruns | 404/118 |
| 4,712,623 | 12/1987 | Martinez | 404/118 X |

*Primary Examiner*—Ramon S. Britts
*Assistant Examiner*—Nancy Connolly
*Attorney, Agent, or Firm*—Seed and Berry

[57] ABSTRACT

A floating screed for asphalt paving machines has the front edge of its sole plated and bullnose sloping rearwardly from the center to assist lateral flow of the hot asphalt material in front of the main screed and to the front of screed extenders.

The bullnose for the sole plate is separate from the sole plate and consists of a pair of bullnose pieces. The construction is such that adjustment of the controlled dishing and warping of the sole plate can be more easily performed.

12 Claims, 3 Drawing Sheets

ASPHALT PAVING MACHINE

SCREED UNIT FOR ASPHALT PAVING MACHINE

TECHNICAL FIELD

This invention relates to screed units for asphalt paving machines of the type in which a floating screed unit is towed by drag arms from a tractor and in which hot asphalt paving material is delivered onto an auger carried by the tractor adjacent the front of the screed to feed the delivered material in both lateral directions for spreading and smoothing by the screed.

BACKGROUND OF THE INVENTION

Floating screed units on asphalt paving machines commonly have a pair of side-by-side frame units mounted on a flexible sole plate. The frame units present coplanar front moldboard sections which are separated sufficiently to permit the sole plate to be dished downwardly as well as upwardly by adjustment mechanisms extending between the side-by-side frame units. The vertical angle of attack of the sole plate is commonly adjusted by pushing or pulling lever arms mounted on the frame units relative to the tow arms which extend from the tractor to pivotal connections with the frame units. This is normally done by manual operation of jack screws extending between the lever arms and tow arms.

It is also common practice to deliberately warp the sole plate so that the angle of attack at one lateral side of the screed is different from that at the other side. This is accomplished by varying the jack screw adjustment at one side of the screed relative to the jack screw adjustment at the opposite side of the screed. This warping operation is made difficult by way of the fact that the sole plate usually terminates at the front by an integral bullnose which substantially stiffens the front portion of the sole plate and is difficult to twist. Commonly the bullnose will be vertically cut at about one-inch intervals adjacent the center of the screed so that upward and downward dishing of the sole plate can be more readily accomplished, but this does not ease twisting of the bullnose required to otherwise warp the sole plate.

The present invention addresses the above described problem while also addressing the need for better lateral spreading of the asphalt paving material between the auger and the front of the sole plate, and particularly when the screed is provided with screed extenders. When in operation, these extenders project laterally beyond the travel path of the ends of the auger which operates in advance of the screed to move the asphalt material laterally in front of the main screed and forward the front of the extenders. Since the auger does not reach in front of the extended portion of the screed extenders, difficulty is often experienced in obtaining a proper supply of asphalt material to the extenders.

BRIEF DESCRIPTION OF THE INVENTION

In accordance with the present invention the forward end of the screed is horizontally tapered to a convex V-shape at the bullnose and moldboard so that the distance between the auger and the bullnose of the sole plate is greater at the ends of the auger than at the center. The front taper to the screed assists in providing adequate lateral flow of the asphalt material in front of the main screed and to the front of the screed extenders while still sufficiently hot and in the proper flow stated.

The bullnose for the sole plate of the main screed is separate from the sole plate and consists of a pair of bullnose pieces mounted on respective of the screed frame units such that they continue forwardly from each half of the sole plate and have a bottom sole extension portion coplanar with the sole plate which is the only part of the bullnose pieces which is secured to the respective frame unit. With this bullnose arrangement it has been found to be noticeably easier to dish and warp the sole plate.

DETAILED DESCRIPTION OF THE INVENTION

Figure 1:
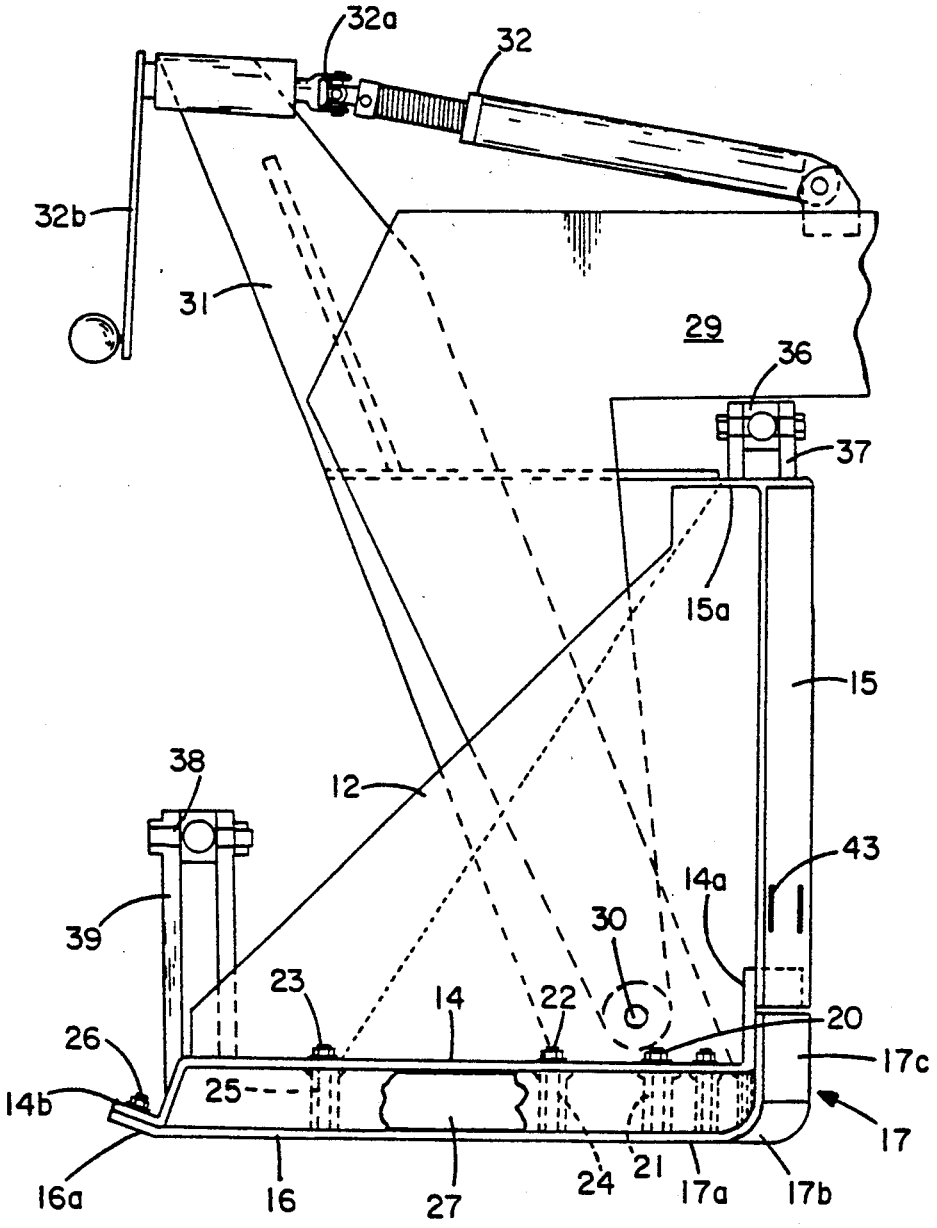
FIG. 1 is an end view of a main screed unit on the paving machine embodying the present invention.
Figure 2:
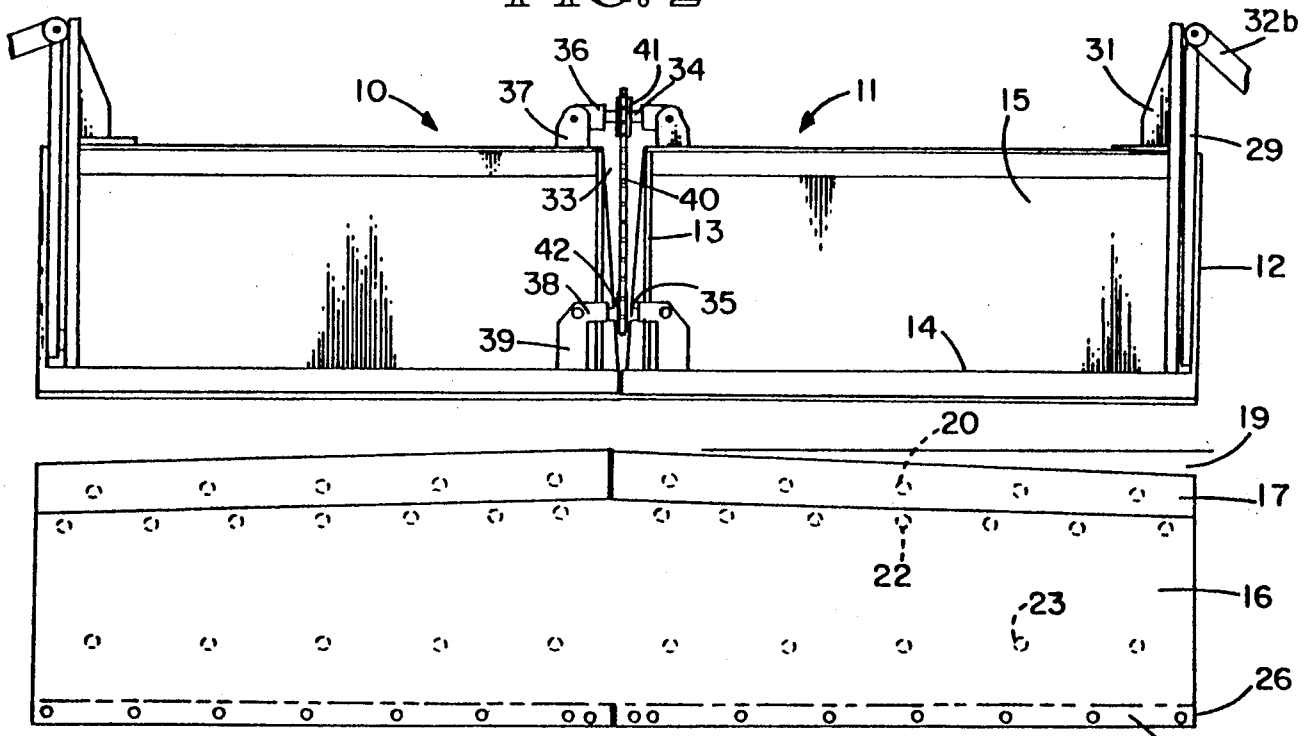
FIG. 2 is a rear elevational view of the screed unit.

The general layout of an asphalt paving machine with a floating main screed equipped with adjustable screed extenders which is towed by a tractor is shown in FIG. 1. Hot asphalt paving material is fed by one or two conveyors from a front hopper on the tractor to an auger carried by the tractor between the tractor and the screed.

The main screed unit has a pair of side-by-side frame sections 10, 11 each comprising an outer generally triangular side plate 12, an inner gusset plate 13, a deck plate 14, and a front moldboard 15. Each deck plate 14 has an upturned front flange 14*a* which is partly overlapped by the respective moldboard 15, and each moldboard has a rearwardly extending top flange 15*a* which overlaps a flat upper edge portion of the respective side plate 12. The side plates 12 and gusset plates 13 are welded in position to the deck plates 14 and moldboards 15 and the moldboards are welded to the front flange 14*a* of the deck plates 14. Near the rear each deck plate 14 bends downwardly and has a back lip 14*b* which has a gentle upward slope.

Figure 3:
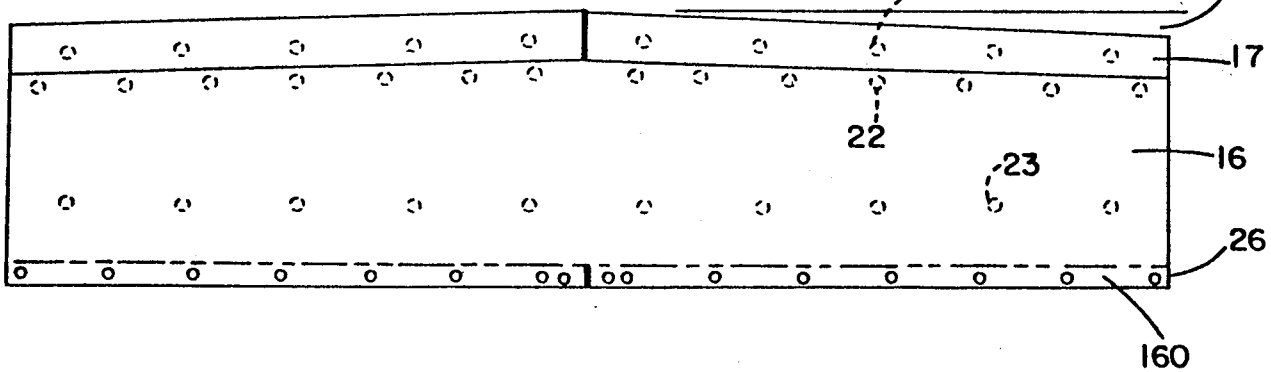
FIG. 3 is a bottom plan view of the screed unit.

The main screed unit also has a sole plate 16 and a pair of side-by-side front bullnose members 17 bent from plate stock. The front edge of the sole plate is tapered laterally in both directions from the center so as to slope rearwardly toward both sides of the screed unit as best seen in FIG. 3. Hence, the front edge of the sole plate has a convex V-shape. This convex V-shape is matched by the back edges of the bullnose members 17 which together provide a concave V-shape. The bullnose sections 17 extend from the sole plate 16 forwardly a short distance by bottom flanges 17*a* and then have a rounded nose portion 17*b* which joins an upturned flange 17*c* which overlaps the respective deck plate flange 14*a* below the respective moldboard element. The front taper angle 19 (FIG. 3) of the screed may be about five degrees.

The bullnose members 17 are held in position by a row of studs 20 which are anchored to the sole plate 16 and pass through tubular spacers 21 seated between the bottom flanges 17*a* of the bullnose members 17 and the deck plate 14. Nuts on the studs 20 seat against the upper face of the deck plate 14. Similarly, the sole plate 16 is held in position by front and intermediate rows of studs 22, 23 and respective spacers 24, 25 and by rear bolts 28 which connect the back lip 14*b* on the deck plates to a matching lip 16*a* sloping upwardly at the rear of the sole plate 16.

The screed unit is towed from a tractor by a pair of laterally spaced drag arms 29 of general L-shape which are pivotally connected to the tractor adjacent their forward ends and are pivotally connected to the screed unit by pins 30 extending through the side plates 12 and a pair of lever arms 31 which are welded to the deck plates 14. Jack screws 32 with universals 32*a* and operating handles 32*b* connect the upper ends of the lever arms 31 to the drag arms 29 so that the lever arms can be pulled forwardly or pushed rearwardly relative to the drag arms 29 to thereby adjust the plane of the sole plate 16 relative to the ground surface to vary the vertical attack angle of the screed. Under normal operating conditions the sole plate 16 is tipped upwardly slightly at the front for a positive angle of attack.

It will be noted that the opposed inner edges of the moldboard members 15 and the opposed inner edges of the upturned flanges 17*c* and rounded nose portions 17*b* of the bullnose members 17 diverge from the plane of the bottom face of the sole plate 16 to form a V-shaped gap 33 (FIG. 3). This gap is provided to permit downward dishing of the sole plate 16 to be performed as will now be explained.

Adjustment is provided for raising or lowering the center of the sole plate relative to the lateral sides so that the sole plate can be dished upwardly to conform with a crown in the road, or can be dished downwardly to provide a drain area for a parking lot, for example. This adjustment is accomplished by operation of front and back laterally extending jack screws 34, 35. The front jack screw extends to two nuts 36 mounted between two pairs of ears 37 anchored to the two moldboard members 15, and the back jack screw 35 extends to two nuts 38 mounted between two other pairs of ears 39 anchored to the deck plates 14. These two jack screws 34, 35 can be operated in unison by way of a chain 40 extending around sprockets 41, 42 mounted on the jack screws. The chain 40 can be driven by a reversible motor (not shown), or a second motor driven sprocket can be provided for the front jack screw 34.

Each jack screw 34, 35 has threaded end portions of opposite hand which screw into the respective nuts 36, 38. Hence, when the jack screws 34, 35 are turned in unison responsive to driving of the chain 40, the two frame sections 10, 11 are pulled toward one another or pushed apart depending on the selected direction of rotation of the jack screws, thereby responsively dishing the sole plate 16 downwardly or upwardly.

It has been found to be advantageous under normal highway paving conditions to dish the sole plate 16 upwardly more at the front than at the rear. This is accomplished by initially preloading the front of the sole plate by manually turning the forward jack screw 34 to extend the distance between the nuts 36 with the chain 40 disconnected. This preloading is maintained when the chain 40 is reconnected.

Figure 4:
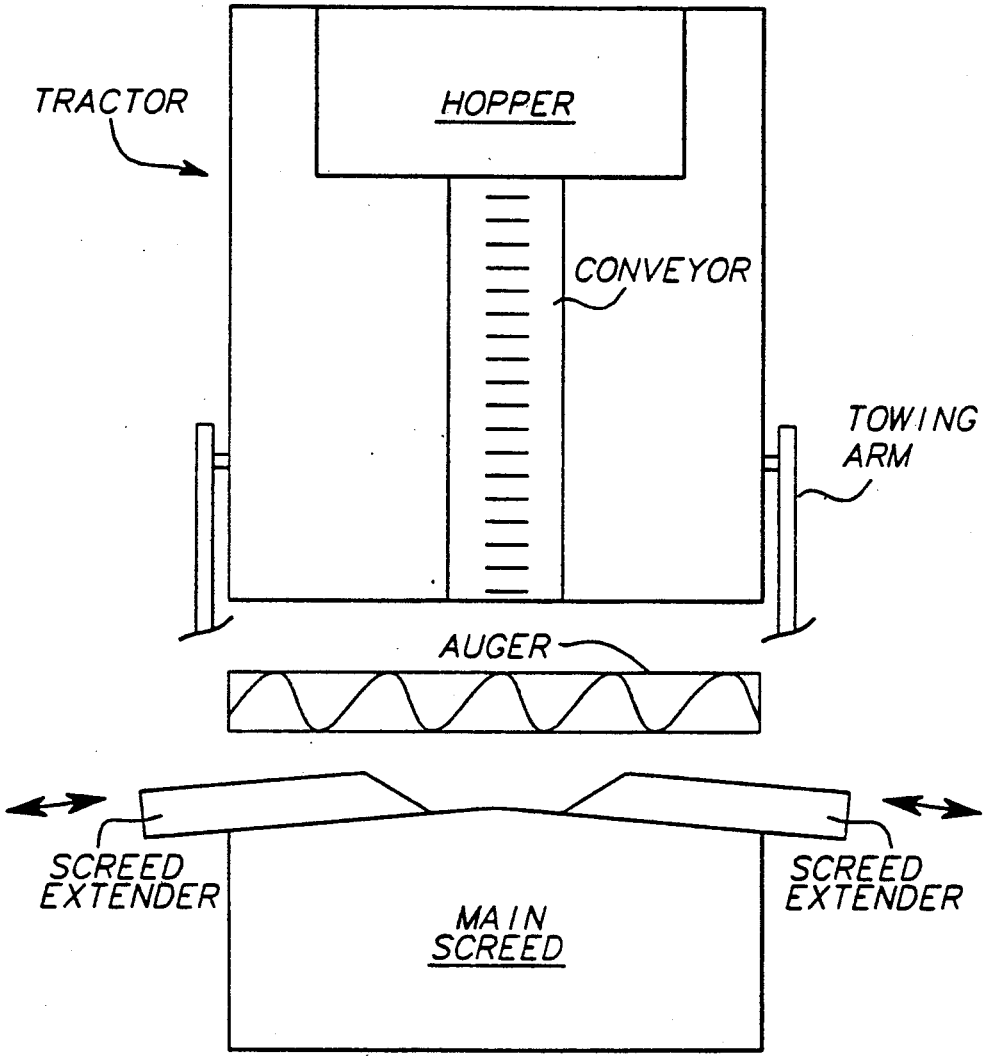
FIG. 4 is a schematic plan view of an asphalt paving machine.

As indicated in FIG. 4, screed extenders may be mounted at the front of the main screed unit behind the auger in the manner disclosed in U.S. Pat. No. 4,818,140. The extenders are slide supported on the moldboard members 15 and ride near the bottom along guide plates (not shown) which are bolted in position covering a lower portion of the front face of the moldboard members and most of the front face of the upturned bullnose flanges 17*c*. Slots 43 are provided in the moldboard members 15 to receive the bolts for mounting the guide plates for the screed extenders.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A screed unit for an asphalt paving machine comprising:

a frame; and a sole plate secured to said frame and extending across the bottom of the screed unit beneath said frame, said sole plate having a front bullnose sloping rearwardly to laterally spaced ends of the bullnose from the center of the front of the sole plate, said sole plate having a back edge extending substantially its entire lateral width which is entirely located behind a straight line connecting said laterally spaced ends of the bullnose;

and towing arms extending forwardly from said frame.

2. A screed unit for an asphalt paving machine comprising:

sole plate means having a front bullnose means extending across the front of the screed unit;

frame means on said sole plate means;

and moldboard means extending upwardly from the front of said bullnose means;

said bullnose means and moldboard means sloping rearwardly from the center toward the lateral sides of the screed unit.

3. A screed unit for an asphalt paving machine comprising:

sole plate means having a front bullnose extending across the front of the screed unit;

side-by-side frame units mounted on said sole plate means and arranged to move laterally of the screed unit toward and away from one another above the sole plate means permitting upward and downward dishing of the sole plate; and adjustment means extending between said frame units selectively moving them laterally toward or away from one another to responsively dish said sole plate downwardly or upwardly, respectively;

said bullnose sloping rearwardly from the center toward the lateral sides of the screed unit and being split at the center.

4. A screed unit for an asphalt paving machine comprising:

a pair of side-by-side deck plates;

a sole plate spaced below said deck plates and secured thereto, said sole plate having its front edge formed with a convex forwardly directed vee-shape;

a front two-piece bullnose having a back edge with a concave vee-shape overlapping said convex vee-shape, said bullnose being split at the center and being secured to said deck plates independently of said sole plate;

and a pair of side-by side moldboards extending above said bullnose and secured to respective ones of said deck plates.

5. A screed unit according to claim 4 in which said deck plates each having an upstanding front deck plate flange directly behind a lower portion of respective ones of said moldboards and directly behind an upper portion of said bullnose, said deck plate flanges sloping rearwardly in correspondence to said convex vee-shape, and said deck plate flanges being secured to said moldboards and not secured to said bullnose.

6. In combination:

a central screed unit having a front bullnose and moldboard sloping rearwardly in both lateral directions from a front central part of the screed unit; and two extender screed units slidably mounted at the front of said central screed unit and extending laterally therebeyond in respective lateral directions with a rearward slope determined by the respective rearward slope of said moldboard.

7. A screed unit for an asphalt paving machine comprising:

sole plate means having a front bullnose extending across the front of the screed unit;

side-by-side frame units mounted on said sole plate means and free to move laterally across the screed unit toward and away from one another above the sole plate means permitting upward and downward dishing of the sole plate;

first adjustment means extending between said frame units selectively moving them laterally toward or away from one another thereby responsively dishing said sole plate downwardly or upwardly, respectively;

a pair of towing arms pivotally mounted on respective ones of said frame units;

a pair of lever arms fixed to said frame units;

and second adjustment means extending between said lever arms and towing arms selectively varying the distance therebetween thereby selectively varying the tilt of said sole plate means;

said bullnose sloping rearwardly from the center toward the lateral sides of the screed unit and being split at the center.

8. A screed unit for an asphalt paving machine comprising:

a pair of side-by-side frames providing a pair of side-by-side deck plates each having an upstanding front deck plate flange;

a sole plate below said deck plates and secured thereto;

a bullnose comprising a pair of bullnose pieces each having a bottom flange adjoined to the front of said sole plate and secured to respective ones of said deck plates, and each of said pieces having an upstanding front flange overlapping a lower portion of a respective one of said deck plate flange;

said frames also presenting a pair of side-by-side moldboards extending upwardly from said front flanges of the bullnose pieces in overlapping relation to respective ones of said deck plate flanges, said deck plate flanges being secured to said moldboards and not being secured to said front flanges of the bullnose pieces;

first adjustment means moving said frames toward and away from one another above a top central portion of said sole plate for selectively dishing the sole plate and bullnose downwardly or upwardly, respectively;

a pair of forwardly extending towing arms pivotally connected to respective ones of said frames; and second adjustment means connected to said frames and towing arms selectively independently tilting said frames relative to respective ones of said towing arms and thereby selectively tilting or warping said sole plate.

9. A screed unit according to claim 8 in which the front edge of said sole plate has a convex vee-shape and the back edges of said bottom flanges of the bullnose pieces jointly have a concave vee-shape overlapping said convex vee-shape, and in which said deck plate flanges, said front flanges of the bullnose pieces, and said moldboards slope rearwardly toward respective lateral sides of the screed unit in accordance with said convex vee-shape.

10. A screed unit according to claim 9 in which a pair of screed extenders are slidably mounted on said frame units and slide laterally along the front of said moldboard in accordance with the rearward slope of the moldboards.

11. A screed unit for an asphalt paving machine comprising:

front moldboard means sloping forwardly in a general vee-shape form laterally spaced ends;

bottom sole plate means extending rearwardly from said moldboard means to a back edge of the sole plate means which extends across substantially the entire lateral width of said sole plate means and is totally spaced behind a straight line connecting said laterally spaced ends of the moldboard means;

a frame on said moldboard means;

and towing arms extending from said frame forwardly beyond said moldboard means.

12. A screed unit according to claim 11 in which said sole plate means has a front bullnose portion joining said moldboard means.

* * * * *

UNITED STATES PATENT AND TRADEMARK OFFICE

CERTIFICATE OF CORRECTION

PATENT NO. : 5,215,404

DATED : June 1, 1993

INVENTOR(S) : Larry Raymond

It is certified that error appears in the above-identified patent and that said Letters Patent is hereby corrected as shown below:

In column 6, claim 11, line 37, please delete "form" and substitute therefor --from--.

Signed and Sealed this

Twenty-second Day of February, 1994

Bruce Lehman

*Attest:*

BRUCE LEHMAN

*Attesting Officer*

*Commissioner of Patents and Trademarks*